US007766628B2

(12) United States Patent
Fields et al.

(10) Patent No.: US 7,766,628 B2
(45) Date of Patent: Aug. 3, 2010

(54) SEALED COMPRESSOR WITH STRUCTURE ON LOWER HOUSING SHELL TO ASSIST WELD PLACEMENT

(75) Inventors: Gene Fields, Arkadelphia, AR (US); Vince Loy, Bismarck, AR (US); Paul J. Cambron, Hot Springs, AR (US); Zili Sun, Arkadelphia, AR (US)

(73) Assignee: Scroll Technologies, Arkadelphia, AZ (US)

( * ) Notice: Subject to any disclaimer, the term of this patent is extended or adjusted under 35 U.S.C. 154(b) by 774 days.

(21) Appl. No.: 11/403,771

(22) Filed: Apr. 13, 2006

(65) Prior Publication Data

US 2007/0243082 A1 Oct. 18, 2007

(51) Int. Cl.

| | |
|---|---|
| ***F04B 35/04*** | (2006.01) |
| ***F01C 1/063*** | (2006.01) |
| ***B23K 31/02*** | (2006.01) |
| ***B23P 15/00*** | (2006.01) |

(52) U.S. Cl. ..... 417/410.3; 418/55.1; 29/888.02; 228/212

(58) Field of Classification Search ..... 228/245, 228/227, 199, 203, 212, 213, 47.1, 49.1, 228/3, 4, 44.3, 44.5; 418/55.1, 55.6, 94; 29/888.02, 888.021–888.025, 464, 527.1; 417/410.3, 902

See application file for complete search history.

(56) References Cited

U.S. PATENT DOCUMENTS

| | | | | |
|---|---|---|---|---|
| 4,424,848 | A * | 1/1984 | Gore et al. | 157/1.28 |
| 4,706,353 | A * | 11/1987 | Zgliczynski et al. | 29/888.025 |
| 5,046,707 | A * | 9/1991 | Allen | 269/309 |
| 5,065,991 | A * | 11/1991 | Schneider | 269/309 |
| 5,328,340 | A * | 7/1994 | Hara et al. | 418/55.1 |
| 5,437,098 | A * | 8/1995 | Horner, Jr. | 29/888.02 |
| 6,247,909 | B1 * | 6/2001 | Williams et al. | 418/55.1 |
| 6,408,645 | B1 * | 6/2002 | Tsuboe et al. | 62/505 |
| 6,488,489 | B2 * | 12/2002 | Williams et al. | 418/55.1 |
| 6,682,327 | B2 * | 1/2004 | Milliff et al. | 418/55.1 |
| 6,695,201 | B2 * | 2/2004 | Narasipura et al. | 228/245 |
| 6,701,595 | B2 * | 3/2004 | Janovici et al. | 29/272 |
| 6,710,483 | B2 * | 3/2004 | Ota et al. | 310/82 |
| 6,732,418 | B2 * | 5/2004 | Rada | 29/428 |
| 6,825,436 | B1 * | 11/2004 | Aoyama et al. | 219/117.1 |
| 6,851,182 | B2 * | 2/2005 | Okada | 29/798 |
| 6,874,219 | B2 * | 4/2005 | Hanssen et al. | 29/525.11 |
| 6,944,927 | B2 * | 9/2005 | Nakamura | 29/407.01 |
| 7,040,862 | B2 * | 5/2006 | Otsuka | 415/214.1 |
| 2002/0006343 | A1 * | 1/2002 | Barito et al. | 418/55.1 |
| 2002/0149385 | A1 * | 10/2002 | Miki | 324/761 |
| 2002/0182092 | A1 * | 12/2002 | Milliff et al. | 418/55.1 |
| 2003/0077193 | A1 * | 4/2003 | Skinner | 418/55.1 |
| 2004/0007437 | A1 * | 1/2004 | Linzell | 192/38 |
| 2006/0195017 | A1 * | 8/2006 | Shluzas et al. | 600/210 |
| 2006/0219193 | A1 * | 10/2006 | Blenn | 123/45 R |
| 2006/0251522 | A1 * | 11/2006 | Matheny et al. | 416/219 R |
| 2007/0003424 | A1 * | 1/2007 | Benco et al. | 418/55.3 |
| 2008/0159828 | A1 * | 7/2008 | Chen | 411/405 |

* cited by examiner

*Primary Examiner*—Charles G Freay
(74) *Attorney, Agent, or Firm*—Carlson, Gaskey & Olds, PC

(57) ABSTRACT

A compressor is provided with a dimple and a lower end cap to receive a positioning fixture pin to position the lower end cap prior to a welding operation. The use of the dimple ensures the lower end cap is properly positioned when welding occurs. In the past, lower end caps have often been misaligned when welded to the center shell. Further, the dimple provides the dual function of positioning a magnet within the compressor housing.

4 Claims, 2 Drawing Sheets

SEALED COMPRESSOR WITH STRUCTURE ON LOWER HOUSING SHELL TO ASSIST WELD PLACEMENT

BACKGROUND OF THE INVENTION

This application relates to a compressor that is sealed within a housing having a center shell, and a lower end cap, and wherein structure in the lower end cap interacts with a fixture pin to properly position the lower end cap during welding.

Sealed compressors are known, and are often utilized in refrigerant compression applications. In a typical sealed compressor, a center shell is generally cylindrical and encloses a compressor pump unit and a motor. An upper end cap seals one end of the compressor shell, and a lower end cap seals the other. The upper and lower end caps are typically welded to the center shell. There are challenges with regard to properly positioning the lower end cap relative to the welder clamping fixture during welding. In fact, a good deal of mis-located end caps have been experienced in the prior art.

SUMMARY OF THE INVENTION

In a disclosed embodiment of this invention, the present invention forms a surface within the lower end cap which is engaged by a fixture pin. The fixture pin is at a known centered location, and thus centers the lower end cap when it engages the structure. In a disclosed embodiment, the structure in the lower end cap is a centered dimple having a curving surface curving toward a center location. The fixture pin is also disclosed as having a curved forward surface. In this way, if the lower end cap is misaligned when initially engaged by the fixture pin, the curved surfaces will guide the lower end cap to the proper location as the fixture pin continues to move forward into engaging and locking the lower end cap. Once the lower end cap is locked at the centered position, a weld electrode can move inwardly to weld the lower end cap to the center shell.

In a disclosed embodiment of this invention, the dimple also provides a secondary function of providing a locating structure for a magnet to remove metallic impurities from a lubricating oil.

These and other features of the present invention can be best understood from the following specification and drawings, the following of which is a brief description.

DETAILED DESCRIPTION OF THE PREFERRED EMBODIMENT

Figure 1:
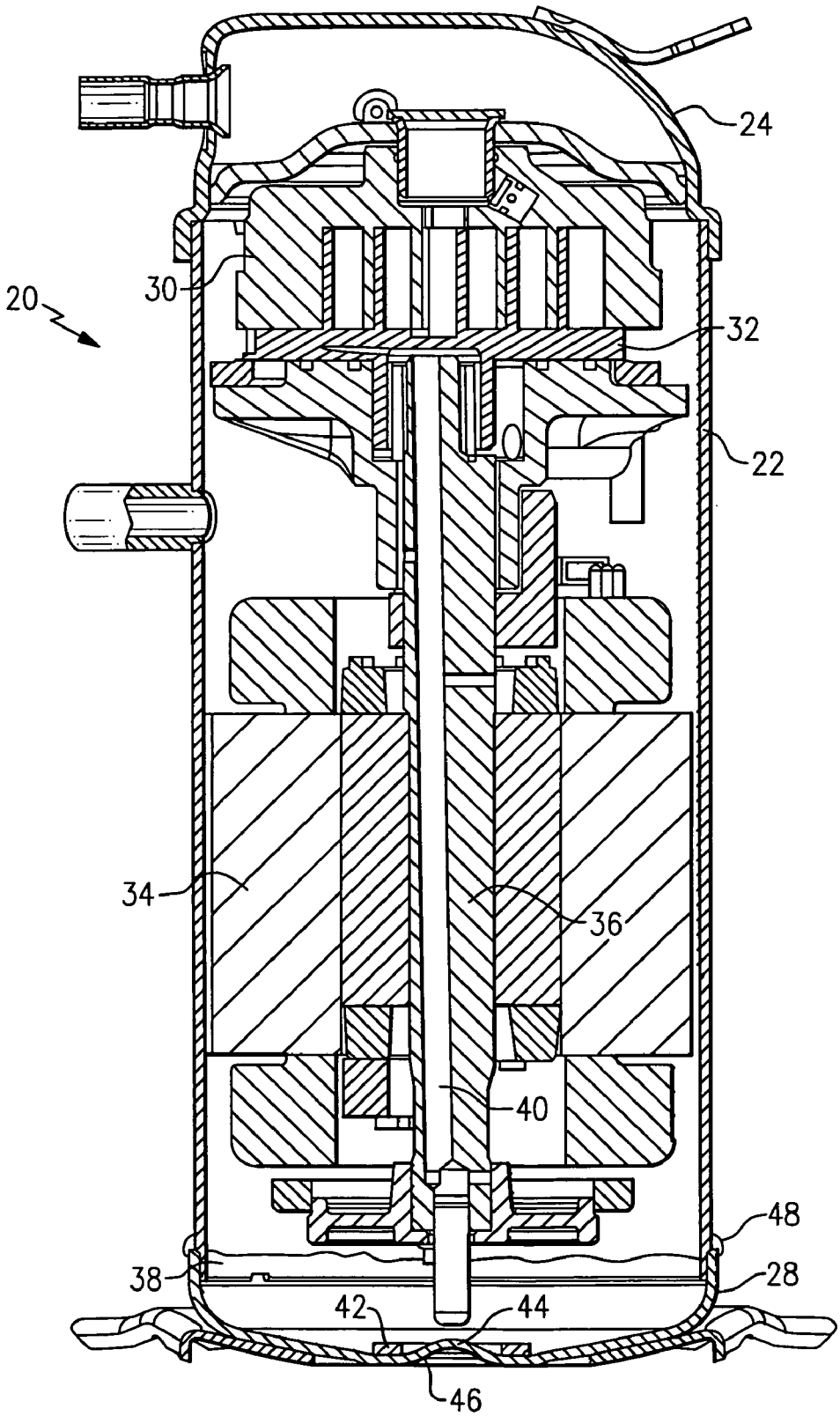
FIG. 1 is a cross-sectional view of a sealed compressor incorporating the present invention.

A sealed compressor 20 is illustrated in FIG. 1. The sealed compressor has a hermetically sealed interior housing including a center shell 22, an upper end cap 24 and a lower end cap 28. The illustrated compressor is a scroll compressor having a non-orbiting scroll element 30 and an orbiting scroll element 32. As is known, an electric motor drives a rotating shaft 36 received within the sealed housing, and within the center shell 22.

As shown, a dimple 44 is formed within the bottom surface of the lower end cap 28. The dimple has a curved outer lower surface 46. As shown in this embodiment, the dimple receives and positions a magnet 42. It is known to place magnets at the end of an end cap in a sealed compressor. The purpose of the magnet is to remove metallic impurities from oil in an oil sump 38 prior to that oil reaching an oil supply passage 40 that is formed in the rotating shaft 36. To date, some additional mounting structure has been required. The dimple 44 is provided in the end cap 28 to provide an alignment surface as will be explained below. However, the dimple also provides this second function.

Figure 2A:
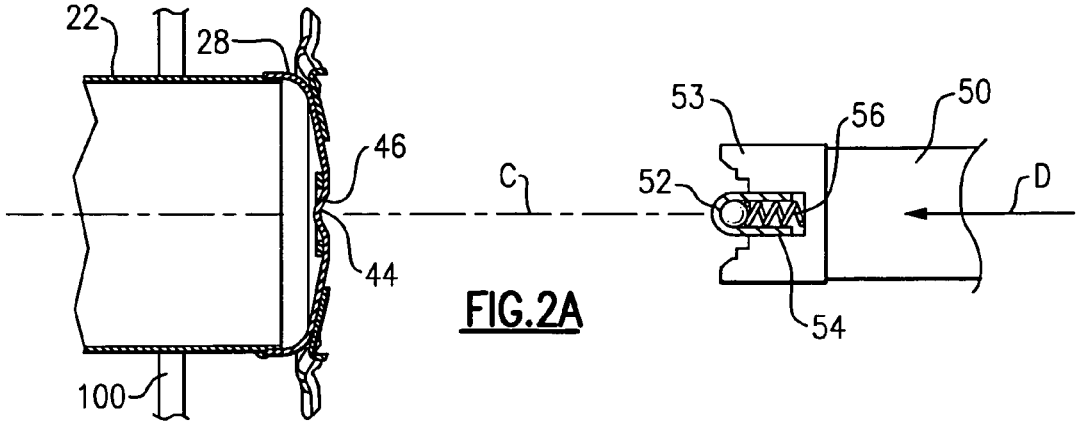
FIG. 2A shows a first method step of forming the scroll compressor of FIG. 1.
Figure 2B:
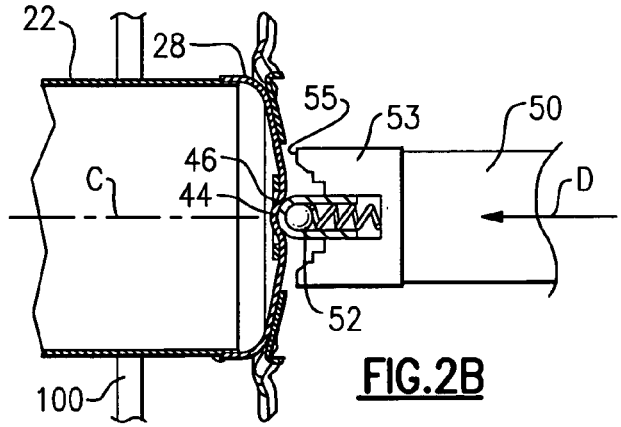
FIG. 2B shows a subsequent step.

FIG. 2A shows a method of properly positioning the lower end cap 28 relative to the fixture center line D during a welding operation. In this embodiment, a fixture tool 50 drives a pin 52 and associated mount structure 53 forwardly toward the dimple 44. As can be appreciated, the pin 52 slides within a recess 54 and is spring biased at 56 outwardly. As the pin 52 (FIGS. 2B and 2C) begins to engage the curved surface 46 of dimple 44, the mating curved surfaces of the pins 52 and 46 will guide the lower end cap 28 to a position centered on a fixture center line D. Thus, should the lower end cap 28 have become somewhat misaligned on the fixture tool 50, the fixture pin 52 will ensure it is centered. A clamp tool 100 is used to pre-position the compressor before it is clamped by fixture tool 50.

Figure 2C:
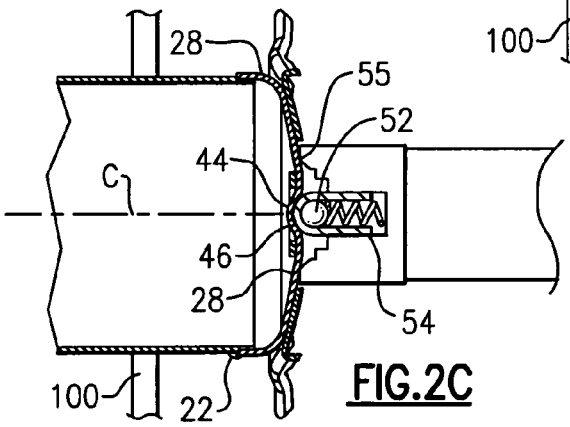
FIG. 2C shows yet another subsequent step.

As shown in FIG. 2C, end structure 55 on the mount structure 53 is now engaging the lower end of the lower end cap 28, and a pin 52 sits firmly within the dimple 44, centering the lower end cap 28 on the fixture tool 50.

Figure 2D:
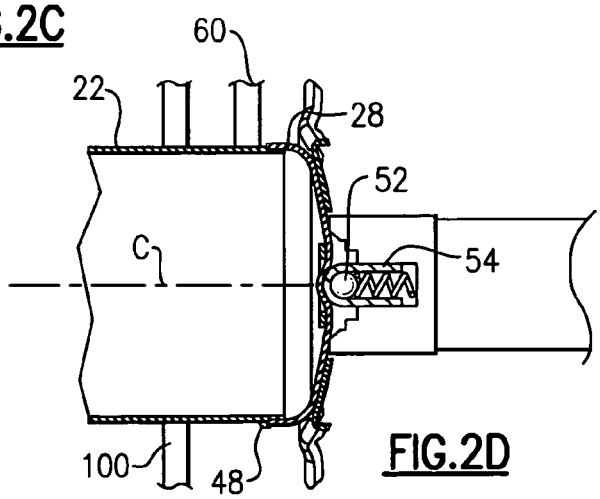
FIG. 2D shows yet another subsequent step.

As shown in FIG. 2D, a weld electrode 60 can now come inwardly and form a weld bead 48 between the lower end cap 28 and the center shell 22.

The present invention thus provides a simple method of properly aligning the lower end cap relative to the clamping fixture during welding. While an embodiment has been disclosed, a worker of ordinary skill in the art would recognize that certain modifications would come within the scope of this invention. For that reason, the following claims should be studied to determine the true scope and content of this invention.

What is claimed is:

1. A method of forming a hermetically sealed compressor housing comprising:

(1) providing a center shell, an end cap for an upper end of said center shell, and a lower end cap for a lower end of said center shell, and said lower end cap having a structure extending into a rear face of said lower end cap;

(2) moving a positioning pin into said structure to position said lower end cap relative to a clamping fixture, said positioning pin centering said lower end cap relative to said clamping fixture; and (3) welding said center shell to said lower end cap to form said sealed compressor housing.

2. The method as set forth in claim 1, wherein said structure is a dimple that is centered on a center line of the compressor housing.

3. The method as set forth in claim 2, wherein a lower face of said lower end cap curves into said dimple, and said positioning pin has a mating curved surface.

4. The method as set forth in claim 3, including the step of mounting a magnet inside said center shell and on said dimple.

* * * * *

UNITED STATES PATENT AND TRADEMARK OFFICE

CERTIFICATE OF CORRECTION

PATENT NO. : 7,766,628 B2
APPLICATION NO. : 11/403771
DATED : August 3, 2010
INVENTOR(S) : Fields et al.

It is certified that error appears in the above-identified patent and that said Letters Patent is hereby corrected as shown below:

ON THE TITLE PAGE:

The Assignee Section should read as follows:

(73) Assignee: Scroll Technologies, Arkadelphia, ARK (US)

Signed and Sealed this

Twenty-third Day of November, 2010

David J. Kappos

David J. Kappos
*Director of the United States Patent and Trademark Office*